United States Patent [19]

Regan

[11] Patent Number: 4,786,941

[45] Date of Patent: Nov. 22, 1988

[54] METHOD OF PROTECTION OF CONFIDENTIAL DOCUMENTS

[75] Inventor: Michael T. Regan, Fairport, N.Y.

[73] Assignee: Eastman Kodak Company, Rochester, N.Y.

[21] Appl. No.: 60,804

[22] Filed: Jun. 12, 1987

[51] Int. Cl.[4] ..... G03G 15/00

[52] U.S. Cl. ..... 355/7

[58] Field of Search ..... 355/3 R, 7, 14 E, 133; 380/54; 283/17, 94, 901

[56] References Cited

U.S. PATENT DOCUMENTS 2,624,958 9/1951 Fine ..... 283/17
4,512,581 4/1985 Levine ..... 283/901 X
4,582,417 4/1986 Yagasaki ..... 355/14 R X
4,586,711 5/1986 Winters et al. ..... 380/54 X

FOREIGN PATENT DOCUMENTS 56-122060 9/1981 Japan ..... 355/7

*Primary Examiner*—Arthur T. Grimley
*Assistant Examiner*—J. Pendegrass
*Attorney, Agent, or Firm*—Leonard W. Treash

[57] ABSTRACT

Two or more copies of a document are made with complementary portions missing for separate secure transporting or storing. The copies may be made on an electrostatic copies having an image erase feature or on a printer which can impress an erase signal on the printing signal.

3 Claims, 3 Drawing Sheets nis racquets in the future will still be made of wood. So called space age materiáls may never have the "feel" players require.

FIG. 1A 3 ra iets 1 th futu wi: stil e ma of
d. - call spa age te .s m ne hav he
el" ayer equ .

FIG. 1B nis cqu s ir ie f ire .l s .l b ide
woc So ( .ed ce ma ia. ay er e th
"fe pla s r ire

FIG. 1C nis racquets in the future will still be made of
wood. So called space age materials may never have the
"feel" players require.

FIG. 2A

FIG. 2B

FIG. 2C

METHOD OF PROTECTION OF CONFIDENTIAL DOCUMENTS

FIELD OF THE INVENTION

This invention relates to a method of protecting confidential documents. More specifically, it relates to a method of creating two or more unintelligible copies of a document which copies can be transported or stored separately but, when combined, are intelligible.

BACKGROUND OF THE INVENTION

A relatively low level of security can be obtained in transporting confidential documents through the mail by cutting the documents lengthwise and mailing the two halves separately. If one half gets misdirected in the mail the unauthorized recipient may find that half somewhat intelligible but, with at least certain documents, will not have truly useful information without the other half.

Numerous optical systems have been proposed through which a document can be copied giving an unintelligible result unless viewed through a similar optical mechanism; see, for example, U.S. Pat. Nos. 3,609,035 and 3,781,109. These devices, of course, require special optical equipment both with the originator and the reader. The single copy contains all the information and if misdirected and unscrambled becomes totally insecure.

SUMMARY OF THE INVENTION

It is the object of the invention to provide a method of rendering a document relatively unintelligible to the casual, unauthorized observer for purposes of transportation, storage or the like which method is easy to carry out by both the originator and the reader, and does not require custom-made equipment to make intelligible by the reader.

This object is accomplished by producing two or more copies of the document with complementary portions of the image missing from each copy.

According to a preferred embodiment, the copies are made in the form of regular or random patterns complementary to each other. For example, they may be in the form of complementary checkerboard patterns.

For most routine security, two copies alone are sufficiently unintelligible. However, according to a preferred embodiment, more than two copies are made of the original document each supplying different portions of the original image.

If the copies are made on opaque paper the reader merely takes all but one of the copies and, using an ordinary copier, copies them onto transparency material, overlays the transparencies on the first copy and reads the document. Of course, if the originator makes all but one of his copies on transparency material, the reader needs to perform no specific acts other than superimposing the copies.

According to a preferred embodiment the copies are produced by an electrostatic copier having a selective erase feature. According to this embodiment, the steps include producing at least two electrostatic images of the document, erasing complementary portions of the images to an extent making each image separately unintelligible, and producing a visible image corresponding to each of the unintelligible images, for example, by toning and transferring the unintelligible electrostatic images.

According to another preferred embodiment the copies are created by first creating an electronic signal corresponding to the information, for example, by electronically scanning the document, combining that signal with complementary pattern signals and using the combined signals to control an electronic printer to make each unintelligible copy.

The invention is useful both in the transportation, for example, by ordinary mail, of documents, and also in the storage of critical documents.

BRIEF DESCRIPTION OF THE DRAWINGS

FIGS. 1A, 1B and 1C show portions of an original document and first and second unintelligible copies, respectively;

FIGS. 2A, 2B and 2C show the same original and first and second of four unintelligible copies, respectively.

SPECIFIC DESCRIPTION OF THE INVENTION

Figure 3:
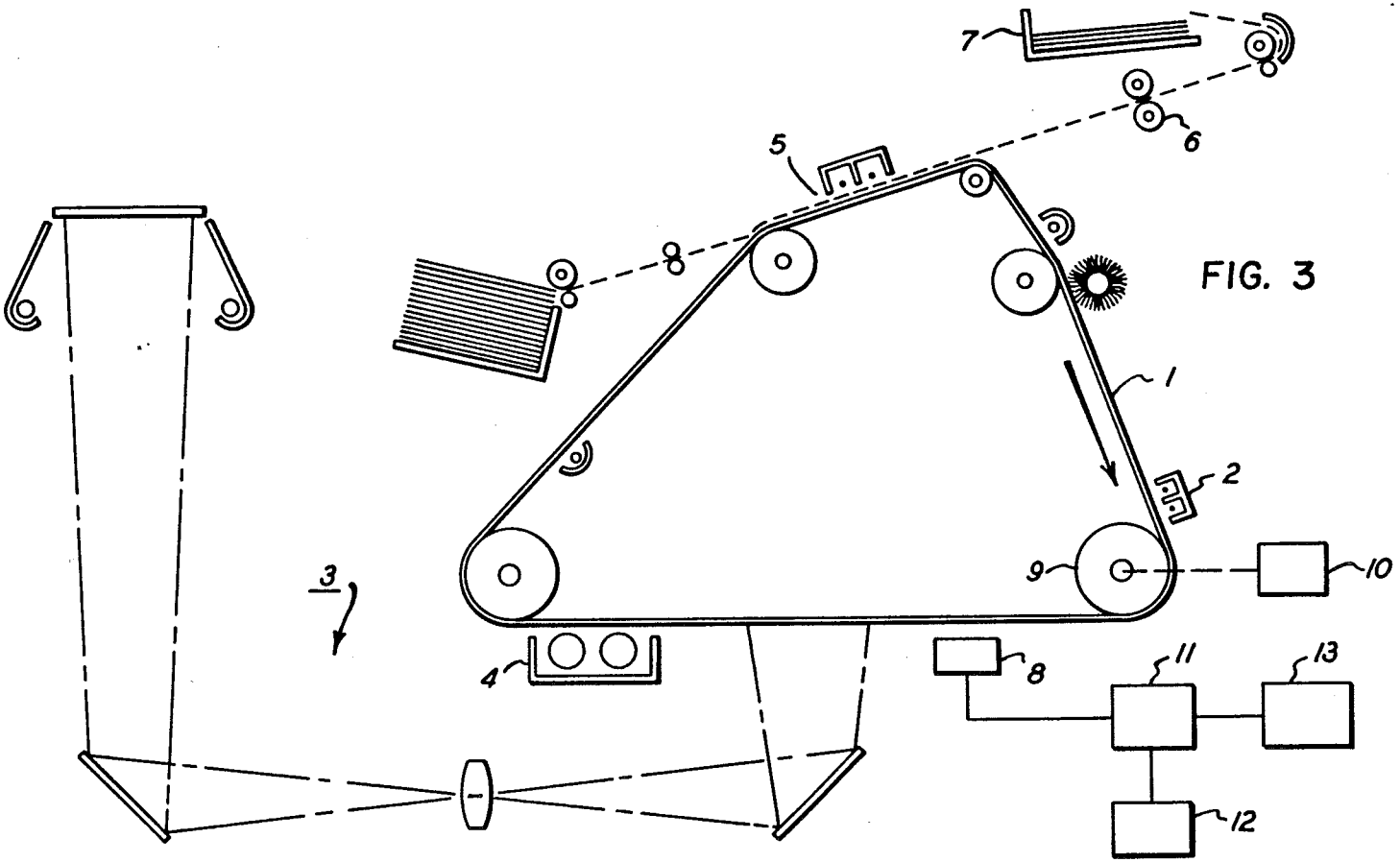
FIG. 3 is a schematic side view of an electrophotographic apparatus particularly suited to carry out the invention.

FIGS. 1A and 2A show a portion of a unintelligible document to be transported or stored in a secure condition. According to FIGS. 1B and 1C the image portion of the original document has been copied twice, but the copies have complementary portions of the image missing. The images shown in FIGS. 1B and 1C are the original image shown in 1A but with the images erased according to complementary checkerboard patterns. These two copies can be sent to a reader in separate envelopes, perhaps on separate days. They can be stored in separate file cabinets, perhaps separate locations. The authorized reader then takes one of the copies and reproduces it on a transparent substrate as can be done with most copiers and superimposes the transparent support on the other copy producing an intelligible copy. Of course, if the originator had made one of the copies on a transparent material the reader would only have to superimpose the copies as received.

According to FIG. 2, the image can be divided into more than two portions. The images shown in FIGS. 2B and 2C each contain one-fourth of the information shown in FIG. 2A. In this instance, of course, four copies would be sent by separate mail (or stored), and the reader would make three of those copies into transparencies.

As can be seen by comparing FIGS. 1B and 1C with FIGS. 2B and 2C, while unintelligible (as used herein), an intelligent person may eventually make out some of the words of one of the copies when the image is divided only in two. Virtually no sense can be made out of the copies in FIG. 2 when the image is divided into fourths.

An apparatus for practicing this invention is shown in FIG. 3, where an endless belt electrophotographic member having a photoconductive surface, herein called a photoconductor 1, is mounted around a series of rollers. The belt is driven by a drive roller 9 powered by a motor 10. The photoconductor 1 is uniformly charged at a charging station 2, imagewise exposed by an exposing mechanism 3 to create an electrostatic image on the photoconductor 1. The electrostatic image is toned at a toning station 4 and transferred to a receiving sheet at a transfer station 5. The receiving sheet is conveyed to a fixing station 6 to fix the toner image and is then conveyed to an output hopper 7.

Between the charging station 2 and the toning station 4 is a write/erase station 8 which may be either before or after the location at which the photoconductor is exposed by the exposing mechanism 3. The write/erase station 8 erases selective portions of the charge by any of a number of well known means. For example, station 8 can selectively expose portions of the photoconductor to a discharging radiation using a laser, an array of light emitting diodes (LED's), an array of electroluminescent panels, or the like. It may also include a non-photo mechanism such as an array of styli emitting a selective discharging (or charging) corona. By way of example only, write/erase station 8 is illustrated as an array of light-emitting diodes arranged across the path of photoconductor 1.

The LED array is well-known in the art for electronically writing in an electrophotographic device of this type. For writing, it commonly employs LED's at a density of from 100–500 per inch and is controlled by an encoder (not shown) which may be coupled to drive roller 9. In an optical copier of the type shown in FIG. 3 the LED array can be used to form the portion of the image making up a letterhead or form. It can number or date pages or the like to produce a composite electrostatic image in cooperation with the optical exposure of the information set on a document platen. Usually it works in a portion of the image area shielded from exposing radiation from the optical exposing mechanism.

The same LED array also can have the function of erasing portions of the image created or to be created by the exposure mechanism 3. It is known to use such an erase mechanism to erase selected complementary portions in consecutive images so that one of them may be toned with one color and the other with a different color. The toned images are then superimposed in the transfer process. It is also known to use such an erase mechanism to apply a fine screen pattern to the entire image or only certain continuous tone portions of the image to improve continuous tone reproduction. The density of the LED's would depend on the range of functions desired. For most erase functions, much less than 100 per inch would be adequate.

In the present invention, the erase station is controlled by a logic and control unit 11 which impresses the output of an electronic pattern generator 12 onto the drives for the erase station. Such output would use a given pattern for one image and the complementary pattern for the other image.

The simpliest form of pattern, that requiring the least sophisticated electronics, would be one in which various groups of diodes across the photoconductor width are left on for one image with the others off and then the pattern reversed for the second image. This would create a pattern in the form of long stripes in the "in track" direction on the photoconductor. This particular pattern would probably be as effective as a checkerboard providing the image is text material running across the pattern. However, most copiers place the images for both letter and legal size documents across the photoconductor. This would leave the text material running in the in-track direction, and the stripe pattern might well be totally ineffective in making the images unintelligible.

A checkerboard pattern would require switching between the two conditions as an image area moves across the LED head. It appears to be superior to stripes for a broad range of applications.

Other patterns, of course, could be used including a randomly generated pattern. Some care must be taken not to make the frequency of the pattern too high, whether random or regular, lest ordinary text material still be intelligible. Determination of the best frequency is well within the skill of the art, and, of course, varies with the original document.

An alternative mechanism for carrying out the invention is also illustrated by FIG. 3. According to this embodiment an image of a document is not directly exposed onto the photoconductor. Instead, a hard copy version of it is scanned at a scanner shown only as 13 in FIG. 3. Scanner 13, of course, may be any of a number of well-known scanners which convert the optical information on a document into an electrical signal, usually using a line or array CCD. The signal from the scanner is fed into the logic and control unit 11 which also receives the pattern generated by the pattern generator 12. Logic and control unit 11 combines the signals to provide a combination signal for write/erase station 8 which is now in a write mode and which creates two complementarily formed partial images on the charged photoconductor 1.

As will be apparent to those skilled in the art, scanner 13 can be replaced by a word processor, so that in fact there may be no original hard copy version of the document. The word processor includes the necessary logic to create the patterned images for supply directly to the write/erase station 8.

While the invention has been described in connection with a preferred embodiment thereof, it will be understood that variations and modifications can be effected within the spirit and scope of the invention as described hereinabove and as defined in the appended claims.

I claim:

1. A method of rendering a document unintelligible to the casual observer for purposes of transportation, storage or the like, comprising the steps of:

imagewise exposing a charged photoconductor to produce at least two electrostatic images of said document in a step separate from said exposing step exposing the respective image portions of said photoconductor to complementary patterns of erasing radiation to erase complementary portions of said images in a pattern making each image separately unintelligible, and producing a visible image corresponding to each of said unintelligible electrostatic images.

2. The method according to claim 1 wherein said erasing step is performed prior to said exposing step.

3. The method according to claim 1 wherein said erasing step is performed by passing said photoconductor under an array of light emitting diodes.

* * * * *